US007690773B2

(12) United States Patent
Hattori et al.

(10) Patent No.: US 7,690,773 B2
(45) Date of Patent: Apr. 6, 2010

(54) INK CARTRIDGES

(75) Inventors: Shingo Hattori, Tsushima (JP); Tomohiro Kanbe, Nagoya (JP); Toyonori Sasaki, Anjo (JP); Motohiro Momozaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/536,681

(22) Filed: Sep. 29, 2006

(65) Prior Publication Data

US 2007/0229615 A1 Oct. 4, 2007

Related U.S. Application Data

(60) Provisional application No. 60/826,254, filed on Sep. 20, 2006.

(30) Foreign Application Priority Data

Mar. 31, 2006 (JP) ..... 2006/099835

(51) Int. Cl.
*B41J 2/175* (2006.01)

(52) U.S. Cl. ..... 347/86; 347/84; 347/85

(58) Field of Classification Search ..... 347/84, 347/85, 86

See application file for complete search history.

(56) References Cited

U.S. PATENT DOCUMENTS

| | | | | |
|---|---|---|---|---|
| 6,899,418 | B2 | 5/2005 | Sasaki et al. | |
| 2004/0183873 | A1 * | 9/2004 | Steinmetz et al. | 347/86 |
| 2005/0068389 | A1 * | 3/2005 | Katayama et al. | 347/86 |

* cited by examiner

*Primary Examiner*—Stephen D Meier
*Assistant Examiner*—Laura E Martin
(74) *Attorney, Agent, or Firm*—Baker Botts L.L.P.

(57) ABSTRACT

An ink cartridge includes a case, and the case includes a first case member. The first case member includes a first wall, and the first wall includes a translucent portion extending from the first wall in a predetermined direction. The translucent portion has an inner space formed therein. The case also includes a second case member connected to the first case member. The first case member and the second case member define an ink chamber therein, and the second case member includes a second wall which is opposite to the first wall, and a support member connected to an interior surface of the second wall. Moreover, the ink cartridge includes a movable member which includes a signal blocking portion. The signal blocking portion is positioned within the inner space of the translucent portion, and the movable member is connected to the support member.

2 Claims, 6 Drawing Sheets

INK CARTRIDGES

CROSS-REFERENCE TO RELATED APPLICATIONS

The present application claims priority from Japanese Patent Application No. JP-2006-099835, which was filed on Mar. 31, 2006, and U.S. Provisional Patent Application No. 60/826,254, which was filed on Sep. 20, 2006, the disclosures of which are incorporated herein by reference in their entirety.

BACKGROUND OF THE INVENTION

1. Field of the Invention

The present invention relates generally to ink cartridges. In particular, the present invention is directed towards ink cartridges which may be used in combination with printers.

2. Description of Related Art

A known printer performs printing by ejecting ink from a nozzle toward a recording sheet. Such a known printer is configured to be used in combination with a removable ink cartridge. The ink cartridge used with this known printer comprises an ink supply hole for supplying ink within an ink chamber to a printer head, which is formed on a lower side of a side wall when the ink cartridge is installed in the printer.

Nevertheless, if the ink jet head attempts to eject ink when there is substantially no ink within the ink chamber, printing is not performed, and air may be drawn into the ink jet head. When air is drawn into the ink jet head, the ink jet head may be damaged, such that the ink jet head may become unusable. Consequently, it is desirable to monitor how much ink is within the ink chamber, and when there is substantially no ink within the ink chamber, to prohibit the attempted ejecting of ink from the ink jet head.

Another known ink cartridge is configured to monitor the ink within the ink chamber. This known ink cartridge comprises a rotating member which is supported by a support member provided on a bottom wall of the ink chamber, such that the rotating member is configured to rotate when the ink cartridge is attached to the printer. A blocking portion is provided on one end of the rotating member, and a float portion is provided on the other end of the rotating member. Consequently, as the surface level of the ink drops due to a decrease in ink within the ink chamber, the position of the float portion along a vertical direction also drops, and the position of the blocking portion along a vertical direction rises, thereby allowing detection of ink depletion.

SUMMARY OF THE INVENTION

A need has arisen for ink cartridges that overcome shortcomings of the related art.

According to an embodiment of the present invention, an ink cartridge comprises a case, and the case comprises a first case member. The first case member comprises a first wall, and the first wall comprises a translucent portion extending from the first wall in a predetermined direction. The translucent portion has an inner space formed therein. The case also comprises a second case member connected to the first case member. The first case member and the second case member define an ink chamber therein, and the second case member comprises a second wall which is opposite to the first wall, and a support member connected to an interior surface of the second wall. Moreover, the ink cartridge comprises a movable member which comprises a signal blocking portion. The signal blocking portion is positioned within the inner space of the translucent portion, and the movable member is connected to the support member.

According to another embodiment of the present invention, an ink cartridge comprises a case, and the case comprises a first case member comprising a first wall. The first wall comprises an ink supply portion or an air intake portion, or both, extending from the first wall in a predetermined direction. The case also comprises a second case member connected to the first case member, and the first case member and the second case member define an ink chamber therein. The second case member comprises a second wall which is opposite to the first wall, and a support member connected to an interior surface of the second wall. Moreover, the ink cartridge comprises a movable member, and the movable member is connected to the support member.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-6, like numerals being used for like corresponding portions in the various drawings.

Figure 1:
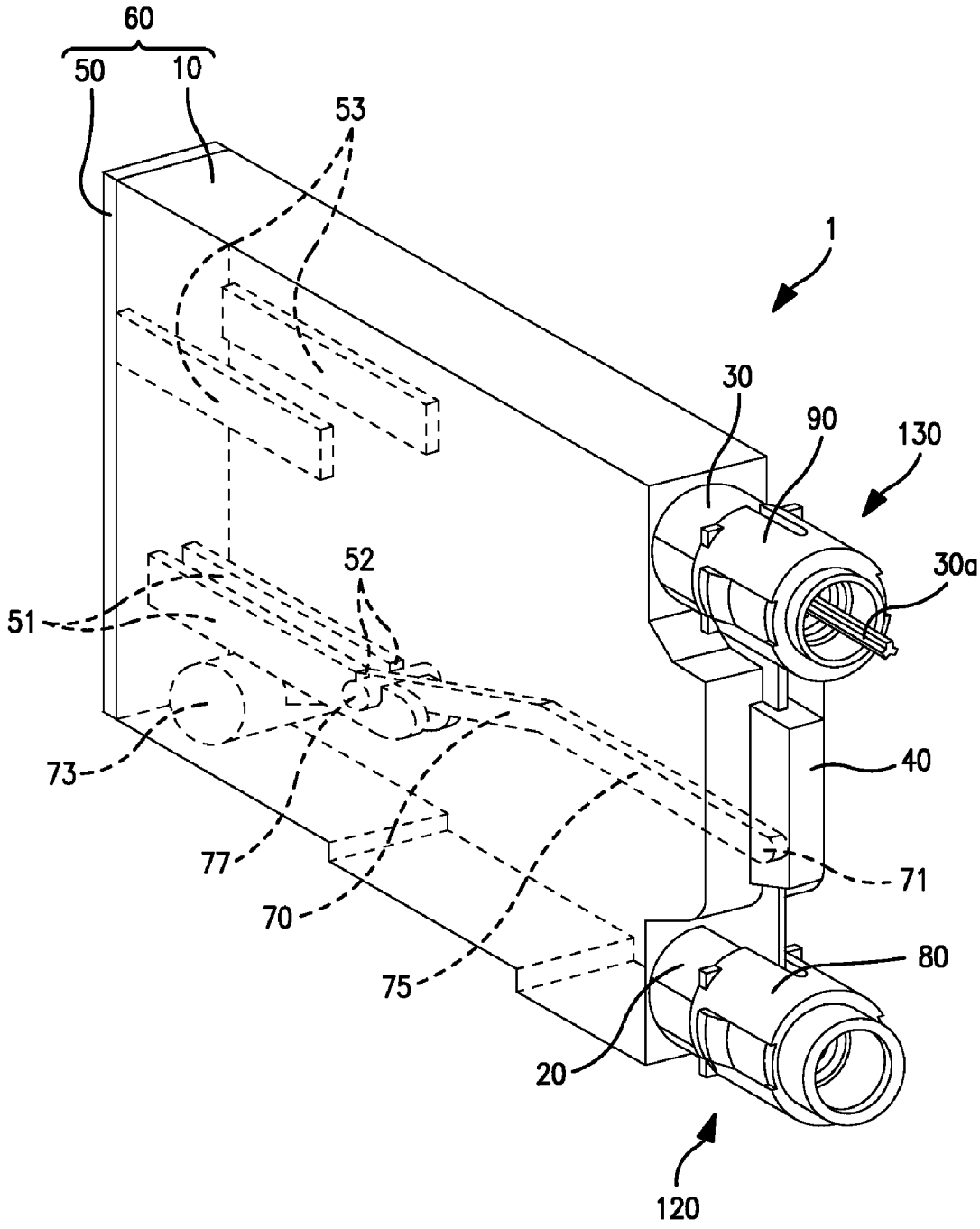
FIG. 1 is an oblique view of an ink cartridge having an ink chamber, according to an embodiment of the present invention.

Referring to FIG. 1, an ink cartridge 1 may have a body comprising a plurality of surfaces, e.g., six surfaces. For example, the plurality of surfaces may comprise a pair of substantially rectangular surfaces which have the largest surface area of the plurality of surfaces, and four (4) side surfaces connected to the pair of substantially rectangular surfaces. As described hereinafter, the direction along the long perimeter of the pair of substantially rectangular surfaces is designated as the lengthwise direction, the direction along the short perimeter of the pair of substantially rectangular surfaces is designated as the short direction, and the direction connected to the pair of substantially rectangular surfaces is designated as the width direction. The pair of substantially rectangular surfaces also are designated as the front surface and the back surface, respectively.

Ink cartridge 1 may have a bottomed box-shaped body 10 having a main opening 11, and a lid 50 configured to close main opening 11 of body 10, and lid 50 and body 11 may comprise a case of ink cartridge 1. Ink cartridge 1 may comprise an ink chamber 60 which is configured to store ink and is defined by lid 50 and body 11, and a movable member 70 which may be supported, in such a manner that it may be configured to rotate based on a change in the amount of ink within ink chamber 60. Ink chamber 60 and movable member 70 may comprise a resin material, e.g., polypropylene, and are manufactured using injection molding. Body 10 of ink chamber 60 may have a light-transmitting property, and movable member 70 may have a light-obscuring property. Additionally, an ink supply portion 120 may be provided in ink cartridge 1, which may supply ink stored in ink chamber 60 from an interior of ink chamber 60 to an exterior of ink chamber 60, and an air-introducing portion 130 which introduces air into ink chamber 60.

Ink cartridge 1 may be installed in printer 1000, such that the surfaces comprising the largest surface area are vertical, and the lengthwise direction of the surfaces forming the largest surface area is along a horizontal direction. At such time, an ink supply portion 120 and an air-introducing portion 130 may be positioned on a side surface, with ink supply portion 120 positioned on the bottom side, and air-introducing portion 130 positioned on the top side.

Figure 2:
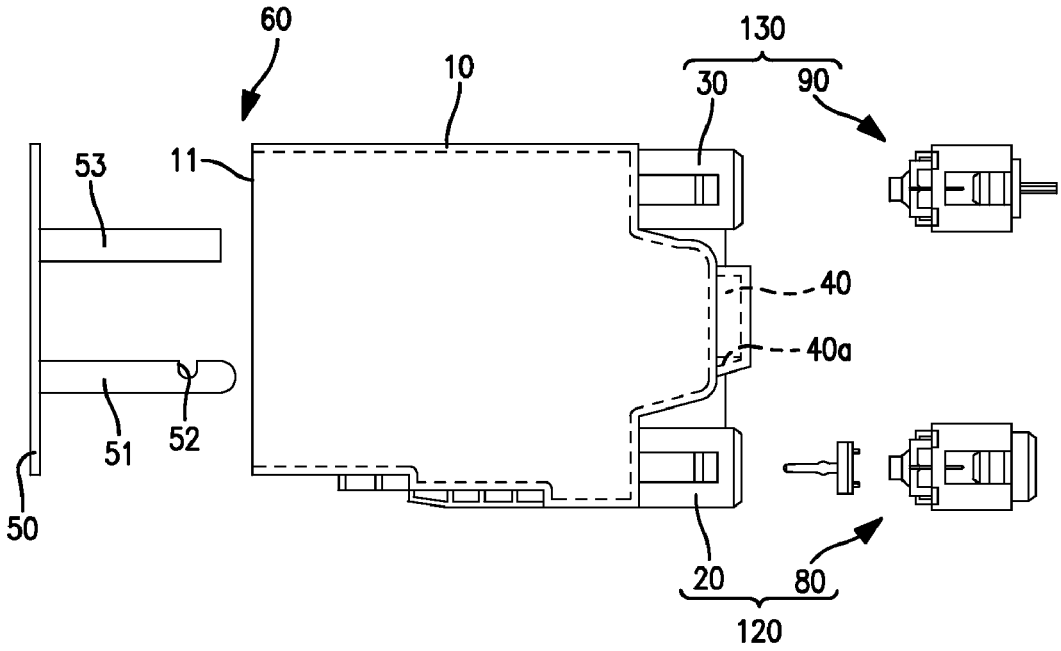
FIG. 2 is a partial, disassembled view of the ink cartridge of FIG. 1.
Figure 3:
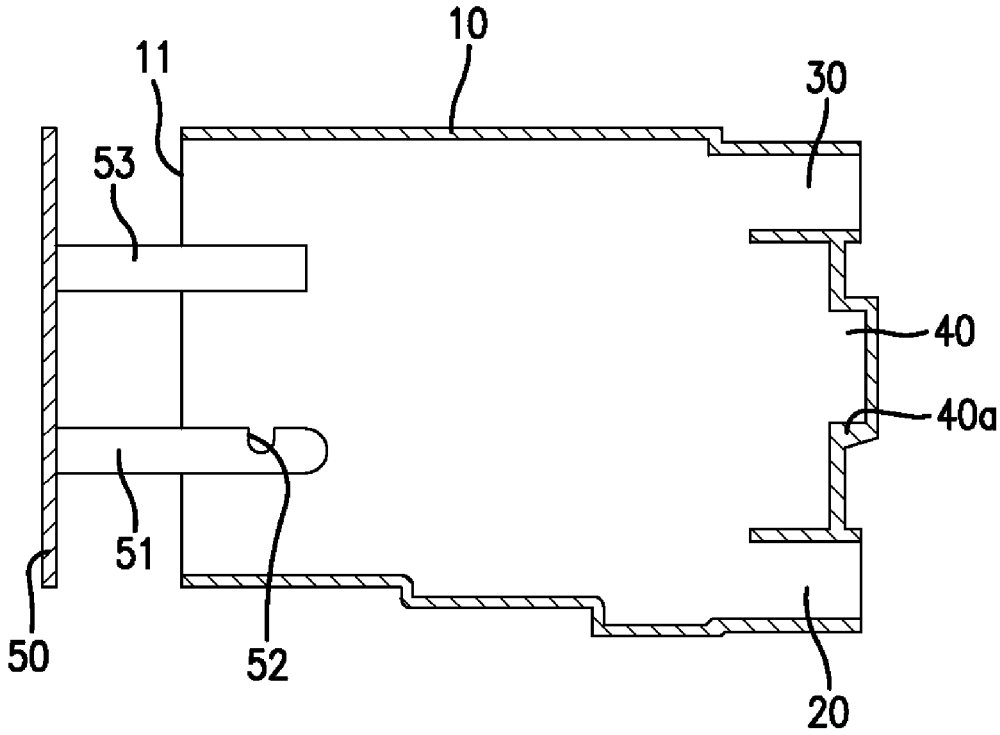
FIG. 3 is a cross-sectional view of a body and a lid of the ink cartridge of FIG. 1.

Referring to FIGS. 2 and 3, on the bottom side of the wall confronting main opening 11 of body 10, an ink supply path 20 may be provided, which communicates with ink chamber 60, and on the top side an air-communicating path 30 may be provided, which communicates with ink chamber 60. In this embodiment of the present invention, the direction facing the inside of reservoir 60 from the wall confronting main opening 11 of body 10 is designated as the "inside direction," and the direction facing the outside of ink chamber 60 is designated as the "outside direction."

Ink supply path 20 and air-communicating path 30 each may have a cylindrical shape extending along the lengthwise direction. One end of ink supply path 20 and air-communicating path 30 may project in the inside direction, and the other end may project in the outside direction. A portion of an ink supply mechanism 80 may be inserted into ink supply path 20 to form an ink supply portion 120. Similarly, a portion of an air-introducing mechanism 90 may be inserted into air-communicating path 30 to form an air-introducing portion 130.

When ink cartridge 1 is not installed in printer 1000, supply mechanism 80 closes the ink flow path, and when ink cartridge 1 is installed in printer 1000, and an ink extraction tube 1015 of printer 1000 is inserted, the ink flow path opens. Consequently, when ink cartridge 1 is installed in printer 1000, ink supply portion 120 is able to supply ink from ink chamber 110 to printer 1000.

Air-introducing mechanism 90 may comprise a rod-shaped valve-opening portion 30*a* which projects toward the outside of air-communicating path 30 when a portion of air-introducing mechanism 90 is placed within air-communicating path 30. When an ink cartridge 1 is not installed in printer 1000, air-introducing mechanism 90 closes off the air flow path, and when an ink cartridge 1 is installed in printer 1000, valve-opening portion 30*a* contacts an installation surface 1013 of printer 1000, and when pressure is applied toward the inside of air-communicating path 30, the air flow path opens. Consequently, when an ink cartridge 1 is installed in printer 1000, air-introducing portion 130 draws air into communication with the inside of ink chamber 60.

Figure 4:
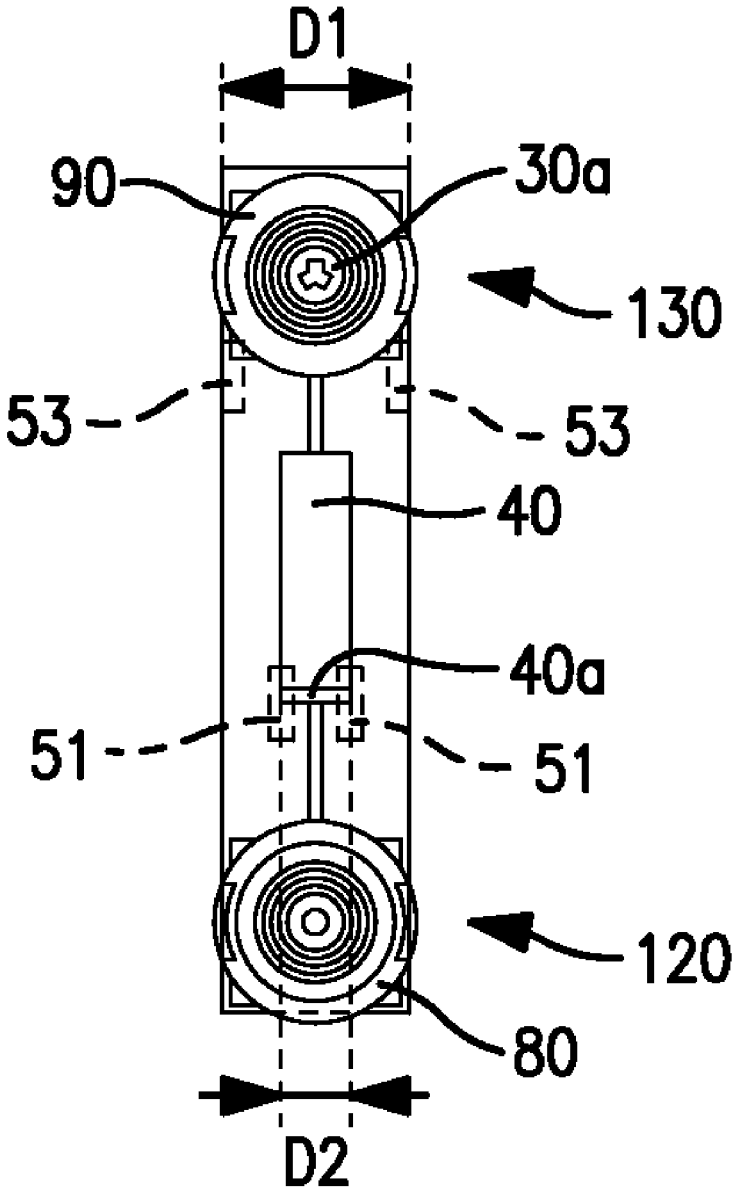
FIG. 4 is a side view showing a side wall in which an ink supply portion and an air-introduction portion of the ink chamber of FIG. 1 are provided.

Referring to FIG. 4, the length along the width direction of ink supply portion 120 and air-introducing portion 130 may be substantially the same as the length D1 along the width direction of ink cartridge 1. Referring again to FIGS. 2 and 3, a translucent portion 40 may project to the outside direction and may provided between ink supply path 20 and air-communicating path 30 on the wall of body 10 on which ink supply path 20 and air-communicating path 30 are provided. Referring to FIG. 4, the length D2 of translucent portion 40 along the width direction may be shorter than the length D1 of ink cartridge 1 along the width direction. A space may be formed inside translucent portion 40, which may communicate with ink chamber 60 and may extend vertically. Referring to FIG. 1, one end of a movable member 70 supported within ink chamber 60 may be disposed within translucent portion 40 and may change its position vertically within the space within translucent portion 40. Moreover, a contact member 40*a* may be provided at the bottom end of the space within translucent portion 40, which contacts movable member 70 when one end of movable member 70 changes its position downward.

Figure 5A:
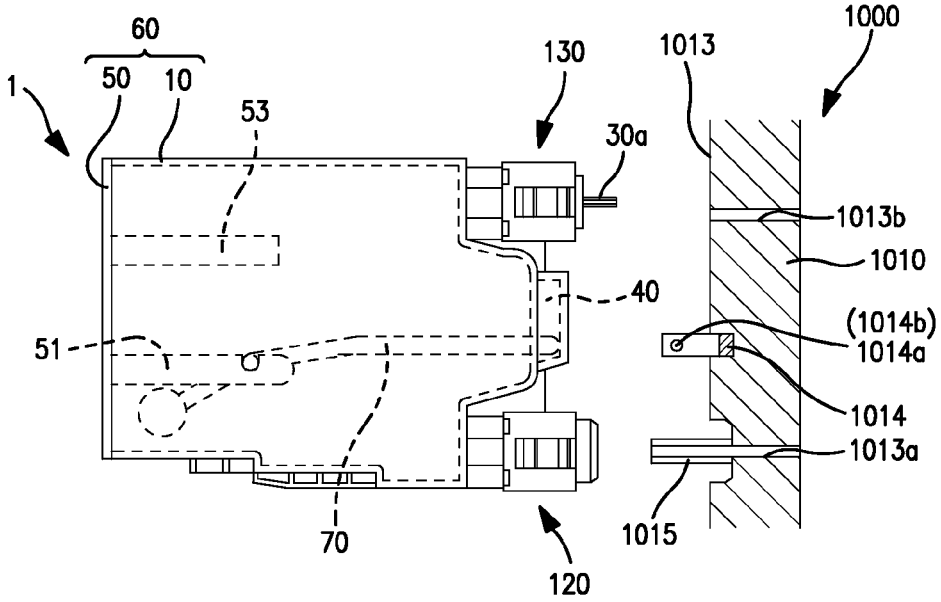
FIG. 5 is a drawing depicting a method for installing the ink cartridge of FIG. 1 into a printer.
Figure 5B:
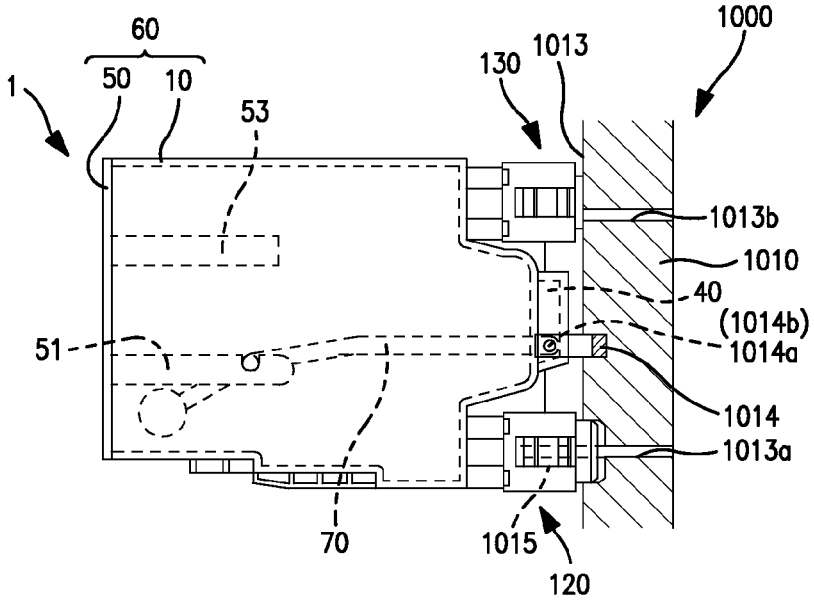

Referring to FIG. 5(*b*), when an ink cartridge 1 is installed in printer 1000, translucent portion 40 positioned between a light-emitting portion 1014*a* and a light-receiving portion 1014*b* of a sensor 1014, e.g., an optical sensor, provided in printer 1000.

A pair of support members 51 may project from a lid 50, which support movable member 70, and when main opening 11 of body 10 is covered by lid 50, a pair of contact members 53 may contact a corresponding one of a pair of mutually confronting inner wall surfaces which form the largest surface area of body 10. Support members 51 may be formed integral with lid 50. Referring to FIG. 4, support members 51 may be provided adjacent to the ends of lid 50 in the width direction, but may be positioned more to the inside than the ends of lid 50 in the width direction, such that support members 51 may form a line along the width direction.

An arm-supporting portion 52 may be formed on support members 51, which supports a shaft 77 of movable member 70, in such a manner that movable member 70 may move in a rotating motion. Arm supporting portion 52 may be a U-shaped cutout as seen from the vertical direction of a paper in FIGS. 2 and 3.

Referring to FIG. 1, movable member 70 may be a substantially rod-shaped member comprising a material with a lower specific gravity than the specific gravity of ink. One end of movable member 70 forms blocking portion 71 disposed within translucent portion 40, and the other end of movable member 40 forms float portion 73. Blocking portion 71 and float portion 73 may be connected via a connecting portion 75.

Connecting portion 75 may have an attachment axis 77 which extends along the width direction of ink cartridge 1. Each proximal end of attachment axis 77 may be supported by a corresponding one of a pair of arm support portions 52 formed in a pair of support members 51. Specifically, each proximal end of attachment axis 77 may fit into the cut-outs of the arm support portions 52, such that attachment axis 77 may not readily be displaced from arm support portions 52, and movable member 70 may rotate freely about attachment axis 77. Consequently, when attachment axis 77 is supported by arm support portion 52, movable member 70 is allowed to rotate with attachment axis 77 as a center of rotation. Moreover, referring to FIG. 1, blocking portion 71 may be located within detection portion 40, and float portion 73 may be located proximal to the bottom side of the wall confronting the wall on which detection portion 40 is provided.

The volume from attachment axis 77 to float portion 73 may be substantially greater than the volume from attachment axis 77 to blocking portion 71. Specifically, the volumes may be selected, such that when float portion 73 is located within the ink, a clockwise moment in FIG. 1 applied to movable member 70 from forces of gravity and buoyancy is greater than the counterclockwise moment, and when a portion of float portion 73 is exposed from the ink surface, the clockwise moment and the counterclockwise moment may be substantially equal. Consequently, after a portion of float portion 73 is exposed from the ink surface, as the amount of ink decreases and the ink surface moves further downward, float portion 73 follows the ink surface and also moves downward. When float portion 73 moves downward, movable member 70 rotates with attachment axis 77 as the rotation center, and blocking portion 71 moves upward.

Figure 6:
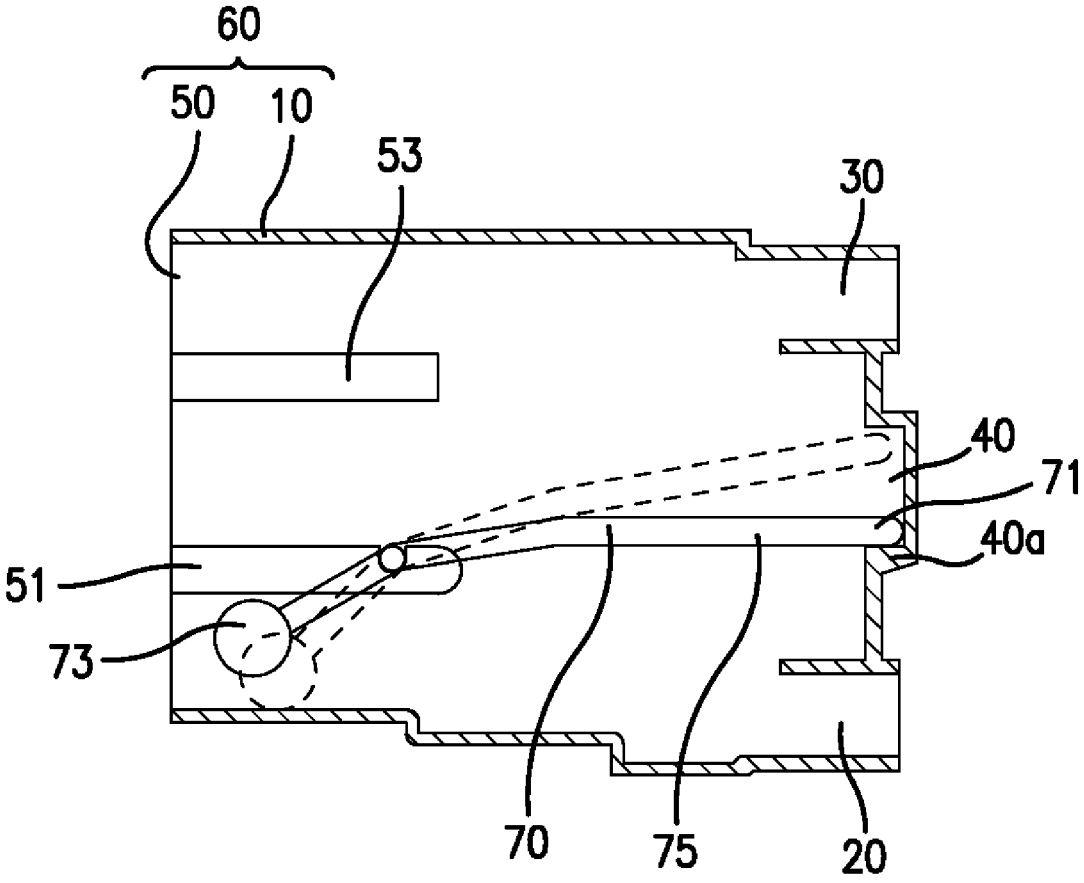
FIG. 6 is a drawing depicting a motion of a movable member of the ink cartridge of FIG. 1.

Referring to FIG. 6, when a force rotating the movable member clockwise in FIG. 6 acts on movable member 70, blocking portion 71 contacts contact member 40*a* within translucent portion 40, and the clockwise rotation of movable member 70 is regulated, such that blocking portion 71 prevents light transmitted from light-emitting portion 1014*a* from being transmitted to light-receiving portion 1014*b*.

In contrast, when the amount of ink within ink chamber 60 decreases, blocking portion 71 changes its position upward within translucent portion 40. When there is substantially no ink within ink chamber 60, float portion 73 contacts the bottom wall of ink chamber 60, and light passes between light-emitting portion 1014*a* and light-receiving portion 1014*b*, thereby providing an indication that there is substantially no ink within ink chamber 60.

Referring to FIG. 5(*a*), a sensor 1014 may disposed in an installation portion 1010 of printer 1000, and sensor 1014 may have a substantially c-shape. The open end of the c-shape may be a light-emitting portion 1014*a* which emits light, and the other end may be a light-receiving portion 1014*b* which receives light. Light-emitting portion 1014*a* and light-receiving portion 1014*b* project from installation surface 1013. When light-receiving portion 1014*b* receives light emitted by light-emitting portion 1014*a*, a signal may not be output to a control substrate provided in printer 1000, and when light-receiving portion 1014*b* does not receive light emitted by light-emitting portion 1014*a*, a signal may be output to the control substrate, or vice versa.

On the bottom side of installation surface 1013 confronting ink supply portion 120, an ink extraction tube 1015 may be provided so as to project, and on the top side confronting air-introduction portion 130 of installation surface 1013, installation surface 1013 may be flat. An ink flow path 1013*a* may be connected to ink extraction tube 1015, and ink passing through ink flow path 1013*a* may be supplied to a discharge port (not shown). An air introduction path 1013*b* may be formed on installation surface 1013 of the air-introduction portion 130 side, and air passing through air-introduction path 1013*b* may be introduced into ink chamber 60.

Referring to FIG. 5(*b*), when ink cartridge 1 is attached to installation portion 1010, ink extraction tube 1015 may be inserted into ink supply portion 120, thereby creating a state in which ink may be supplied, a valve-opening portion 30*a* of air introduction portion 130 may contact installation surface 1013, thereby creating a state in which air may be introduced, and translucent portion 40 may be positioned between light-emitting portion 1014*a* and light-receiving portion 1014*b* of sensor 1014, thereby creating a state in which the amount of ink within ink chamber 60 may be determined.

In order to manufacture ink cartridge 1, body 10 and lid 50 of ink chamber 60 may be resin-molded. At such time, body 10 may be formed, such that the direction perpendicular to the wall on which ink supply path 20 and air-communicating path 30 are provided is the direction from which body 10 is extracted from the molding die. Lid 50 also may be formed, such that the direction that support members 51 and contact members 53 project is the direction from which lid 50 is extracted from the molding die.

Next, a separately fabricated and assembled ink supply mechanism 80 and air-introduction mechanism 90 may be attached to ink supply path 20 and air-communicating path 30, respectively, to form ink supply portion 120 and air-introduction portion 130. Thereafter, attachment axis 77 of movable member 70 fabricated separately by resin-molding may be fitted into arm-supporting portion 52 of lid 50. Main opening 11 of body 10 also may be covered by lid 50. At such time, blocking portion 71 of movable member 70 may be disposed within translucent portion 40 of body 10. Next, body 10 and lid 50 are welded together. The welding of body 10 and lid 50 may be performed without gaps to prevent leakage of ink stored in ink chamber 60.

As described above, ink cartridge 1 may comprise a bottomed box-shape body 10 having a main opening 11, a lid 50 which closes main opening 11, an ink chamber 60 which stores ink, and a movable member 70 supported in such a manner that it may rotate corresponding to the amount of ink remaining in ink chamber 60. In the wall confronting main opening 11 of body 10 there is provided an ink supply path 20 which communicates with ink chamber 60. Moreover, a pair of support members 51 may project from lid 50, which face the inside of ink chamber 60 and support movable member 70. Consequently, it is not difficult to extract body 10 from the molding die when resin-molding is performed, such that the extraction direction is direction perpendicular to the wall in which ink supply path 20 is formed, and is different from the case that a member supported by movable member 70 is provided on a bottom wall of body 10 when the ink cartridge is installed in printer 1000. Consequently, it is possible to resin-mold the ink cartridge using an easily designed molding die. In addition, an air-communicating path 30 may be provided above translucent portion 40 on the wall confronting main opening 11 of body 10. Consequently, air-communicating path 30 may be resin-molded using an easily designed molding die.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge, comprising:

an ink supply portion;

a case comprising:

a first case member comprising a first wall, wherein the first wall comprises a translucent portion positioned at the first wall, and the translucent portion has an inner space formed therein, wherein the ink supply portion is positioned at the first wall; and a second case member connected to the first case member, wherein the first case member and the second case member define an ink chamber therein, and the second case member comprises:

a second wall which is opposite to the first wall; and a support member connected to an interior surface of a predetermined portion of the second wall, wherein the predetermined portion of the second wall is parallel to at least a portion of the first wall, and the support portion extends from the predetermined portion of the second wall towards the ink supply portion and the translucent portion; and a movable member comprising a signal blocking portion, wherein the signal blocking portion is positioned within the inner space of the translucent portion, and the movable member is connected to the support member, wherein the first case member further comprises a third wall connected to and perpendicular to the first wall and a fourth wall connected to and perpendicular to the first wall, wherein the fourth wall is opposite to and parallel to the third wall, and the second wall is connected to both of the third wall and the fourth wall, and wherein the translucent portion extends from the first wall in a predetermined direction away from the second wall.

2. The ink cartridge of claim 1, wherein the support member is integral with the second wall.

* * * * *